United States Patent [19]

Simpson

[11] 4,244,622

[45] Jan. 13, 1981

[54] HANGING CHAIR

[76] Inventor: Clifford G. Simpson, 14714 High Valley Rd., Poway, Calif. 92064

[21] Appl. No.: 77,309

[22] Filed: Sep. 20, 1979

[51] Int. Cl.[3] ..... A47D 13/10

[52] U.S. Cl. ..... 297/273; D6/54; 297/276; 297/458

[58] Field of Search ..... 297/454, 458, 459, 284, 297/273, 276, 277; D6/52, 53, 54, 10, 60; 5/120, 127; 272/85

[56] References Cited

U.S. PATENT DOCUMENTS

| | | | |
|---|---|---|---|
| D. 253,142 | 10/1979 | Herman | D6/60 |
| 285,299 | 9/1883 | Morton | 5/120 |
| 390,393 | 10/1888 | Norris | 5/120 |
| 490,287 | 1/1893 | House | 297/273 X |
| 1,500,338 | 7/1924 | Shuman | 297/276 |
| 2,600,675 | 6/1952 | Nelson | 297/276 |
| 2,798,538 | 7/1957 | Dreifke | 297/458 X |
| 4,113,312 | 9/1978 | Skalka | 297/445 X |
| 4,116,433 | 9/1978 | Koerner | 272/85 |
| 4,192,547 | 3/1980 | Geier | 297/458 X |

FOREIGN PATENT DOCUMENTS

| | | | |
|---|---|---|---|
| 8409 | of 1892 | United Kingdom | 297/276 |

*Primary Examiner*—James T. McCall
*Attorney, Agent, or Firm*—Frank D. Gilliam

[57] ABSTRACT

A hanging chair comprising a plurality of flexibly attached crosspieces adapted to conform to the shape of the person sitting therein. A plurality of crosspieces are arranged in a parallel, slightly spaced, array. A plurality of short contour control boards are positioned with one end filling the space between the crosspieces near the crosspiece ends. A body cable is threaded through aligned holes through the crosspieces and first ends of the contour control boards therebetween. The body cable is fastened in a firm but flexible manner at each end. A hanging cable is threaded through holes in the other end of said contour boards (which are preferably longer near the edges of the crosspiece array and shorter near the center) and extended up to an overhead support. Since the second ends of the contour boards are not kept apart by intermediate crosspieces as are the first ends, the second ends move together, forming a rounded contour in which a person may be comfortably seated. The lengths selected for the various boards determines the basic seat shape. Since the hanging cable fairly tightly fits the contour board holes, the spacing of second board ends may be adjusted for comfortable seating which will be retained by the weight of the seat occupant jamming the hanging cable against the hole edges. Thus, a simple, comfortable, easily adjusted hanging chair is provided.

8 Claims, 3 Drawing Figures

10
12
14
15
16
18
20
22
24
26
28
30
32
34
36

HANGING CHAIR

BACKGROUND OF THE INVENTION

This invention relates in general to chairs and, more specifically, to adjustable hanging chairs.

A great many hanging chairs, swings, baskets and hammocks have been designed. Most tend to be similar to a conventional chair with a rigid seat and back, hung from overhead cables. Such chairs tend to be non-adjustable and not comfortable for all persons. Typical of such hanging chairs are those disclosed by Shaw in U.S. Pat. No. 1,189,393 and Shields in U.S. Pat. No. 317,027.

Some attempts have been made to make parts, such as the backs, of such chairs adjustable, as disclosed, for example, by Gottgar in U.S. Pat. No. 787,556 and Gushman in U.S. Pat. No. 1,393,774. However, these chairs still have rigid, hard, seating and surfaces of limited comfortability.

Other known chairs use a plurality of parallel slats on curved metal forms, such as disclosed by Yeager in U.S. Pat. No. 790,242 and Lansberry in U.S. Pat. No. 872,736. While these curved seating surfaces improve comfort in some ways, the chairs are still hard, rigid and not adjustable.

Hammocks of various types have the advantage of soft, flexible seating. However, they are more bed-like than chair-like and do not provide comfortable upright seating. Randall, in U.S. Pat. No. 777,919, describes a hammock in which the foot portion can be lowered, so that the accupant's legs can extend downwardly, rather than horizontally. Yet, the upper body remains nearly horizontal and the resulting arrangement is still more hammock than chair.

Thus, there is a continuing need for improved hanging chairs overcoming the above-noted problems and providing improved comfort, adjustability and simplicity.

SUMMARY OF THE INVENTION

The above problems, and others, are overcome in accordance with this invention, by a hanging chair comprising a parallel array of uniform, slightly spaced, crosspieces and a plurality of short contour control boards arranged perpendicular to the crosspiece array with one end of each of the boards in the space between said crosspieces near the crosspiece ends. Two body cables extend through aligned holes in said crosspieces and the contour board ends therebetween. The body cables are secured in a firm and flexible manner as described below. Two hanging cables extend through holes near the second ends of said contour boards, then up to any suitable overhead support. When the chair is hung from said hanging cables, the outer ends of said contour boards not spaced by crosspieces move together, forming said crosspiece array into a curved contour when viewed from the ends of said crosspieces. The desired contour can be achieved by selecting the relative length of various of the contour control boards and the distance between adjacent contour boards at the hanging cable end.

To maintain said contour control boards substantially perpendicular to said crosspieces, it is preferred that backing boards be placed behind the end few crosspieces with the end few contour control boards extending between the end crosspieces also extending between the backing boards. The body cable then may extend through the aligned holes in crosspieces and contour boards, out the end of the array, then double back through aligned holes in the backing boards and contour board extended ends. Finally, the body cable is secured in place, such as by knotting the end thereof adjacent to the board.

BRIEF DESCRIPTION OF THE DRAWING

Details of the invention, and of several preferred embodiments thereof, will be further understood upon reference to the drawing, wherein.

DETAILED DESCRIPTION OF THE INVENTION

Figures 1, 2, 3:
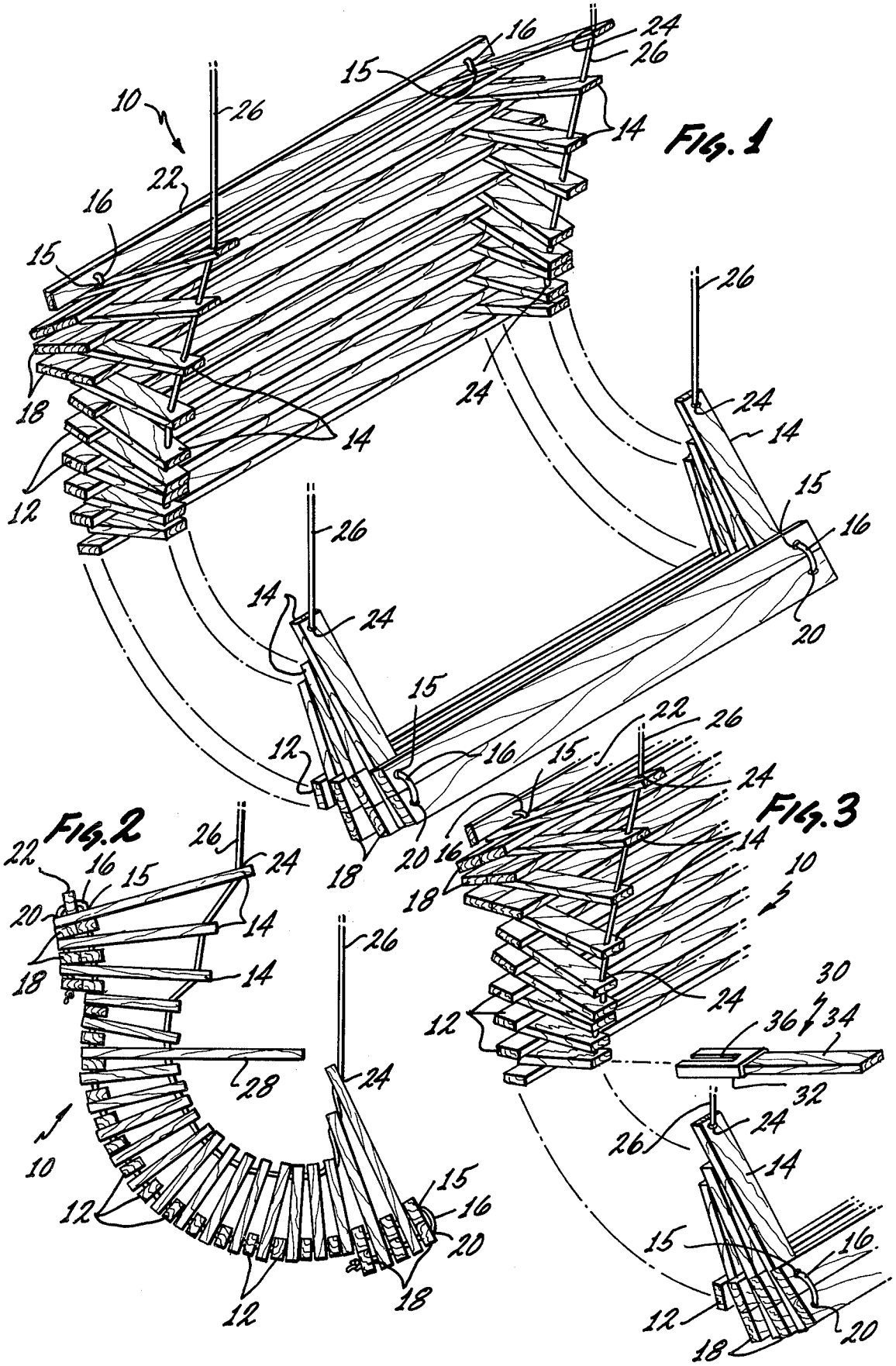
FIG. 1 is a perspective view of a hanging chair according to this invention.
FIG. 2 is an end elevation view of the hanging chair of this invention showing an alternative embodiment of a portion of the chair.
FIG. 3 is a partial perspective view of the hanging chair illustrating a second alternative embodiment of a portion of the invention.

Referring now to FIG. 1, there is seen a perspective view of a hanging chair 10, hanging from a support (not shown) above the chair. A person seated in chair 10 would rest on crosspieces 12 with the curve of the chair conforming substantially to his body. The contour of the hanging chair back can be varied, as described below.

When assembling chair 10, crosspieces 12 could be arranged in a flat, slightly spaced, parallel array. Contour control boards 14 are inserted into the spaces between spaced crosspieces 12 near the ends of the crosspieces. Ordinarily, all boards 14 have the same thickness to uniformly space crosspieces 12. However, if desired, boards 14 of varying thickness could be used. As discussed below, the contour of the chair is controlled by the dimensions selected for boards 14 and can be further modified by adjusting the positions of some of the boards 14. Holes 15 in crosspieces 12 and contour boards 14 are then brought into alignment. Body cables 16 are threaded through the holes 15. Body cables 16 may be knotted outside the end crosspieces 12. However, for greater strength and to hold contour control boards 14 perpendicular to the crosspieces 12, it is preferred that a few, typically from 2 to 6, backing boards 18 be used in conjunction with the end several crosspieces 12 as shown in the drawing. These end contour boards 14 are held by the combination of backing boards 18 and end crosspieces 12 in position perpendicular to the crosspieces. These end contour boards 14, through body cables 16 and hanging cables 24 (as discussed below), serve to flexibly hold the remaining boards 14 in the proper alignment.

The endmost contour boards 14 are progressively slightly longer and extend behind crosspieces 12 (as seen most clearly in FIG. 2). These particular contour boards 14 have second holes near their ends, aligned with holes 20 in backing boards 18. Body cables 16 are threaded back through backing boards 18 and the ends of the corresponding boards 14 and then knotted. The cables should be pulled snug before knotting, since the inherent flexibility and stretch of the cables are generally sufficient to permit the chair to be shaped into the desired contour. While the body cables 16 can go directly from the hole in the last crosspiece 12 to the last backing board 18, as seen at the lower edge of the chair in the drawing, it is preferred that a brace board 22, usually identical with a crosspiece 12, be installed at the upper back edge of the chair as seen in the drawing for maximum strength and flexibility, either in place or or in addition to the last crosspiece and backing board.

The second or outer end of each contour control board 14 has a hole 24 generally similar to holes 15 and 20. Two hanging cables 26 are threaded through holes 24, then extend upwardly to a sturdy overhead support (not shown). The four ends of cables 26 may be secured to the support, or each cable 26 may be in the form of a continuous loop and merely hung over hooks in a patio roof beam or similar structure.

All of the various boards may be formed from any suitable material. Usually wood, such as pine, fir or redwood, is preferred for the optimum combination of strength, lightness and appearance. However, metal, plastic or other materials may be used, if desired. Typically, all of the boards may be cut to the desired length from nominal one inch by two inch lumber. The weight of a person seated in the chair bears on the narrow edges of crosspieces 12 with the smallest dimension of crosspieces 12 lying perpendicular to contour boards 14, thus providing the greatest supporting strength and resistance to bending.

Body cables 16 and hanging cables 26 may be formed from any suitable material. While conventional rope, such as hemp, manila or cotton may be used, plastic materials such as nylon, polyethylene and polypropylene are preferred. Other materials, such as plastic coated metal cable, chains, etc., could also be used but are less effective. Best results have been obtained with nylon rope, typically having diameters from about $\frac{3}{8}$ to $\frac{7}{8}$ inch.

Holes 15, 20 and 24 may have any suitable diameters, equal to or somewhat greater than the diameter of the cables threaded therethrough. Preferrably, the holes are only slightly larger than the corresponding cable, typically up to about 1/16 inch larger in diameter. With this close spacing, there is sufficient friction between the cable and hole, with the cable attempting to pass through the hole at an angle, so that the outer ends of contour boards 14 can be adjusted by the user to produce a chair contour of maximum comfort to him. Friction holds the adjustment until manually changed. In FIGS. 1 and 3 the upper end contour boards 14 are shown rather closely spaced, while upper end contour boards 14 in FIG. 2 illustrate a selected somewhat greater spacing. The spaces between other boards can be similarly varied.

Crosspieces 12 and contour control boards 14 may have any desired length. Relatively short crosspieces 12 (e.g., 24 inches) could produce a single chair, while longer crosspieces (e.g., 60 inches) would permit more than one person to be seated at a time. The length of the central contour control boards 14 determines the basic chair radius; longer boards 14 producing a gently curved chair and shorter boards 14 producing a tightly curved chair. Usually the use of longer contour control boards 14 near the upper and lower chair ends is preferred to premit the curve to be widened, or even reversed, for greater comfort.

FIGS. 2 and 3 further illustrate two alternative embodiments in which an armrest can be provided. In FIG. 2, one of the central contour boards 14 is replaced with a longer board 28. By carefully selecting the position of the long board 28, a comfortable armrest is provided.

Where persons of significantly different sizes are to use the chair, an adjustable armrest, as shown in FIG. 3, may be preferred. Here, an extension arm 30 having a socket 32 at one end adapted to fit tightly over the outer end of any contour board 14 and an opposite end 34 similar to boards 14 is provided. Socket 32 has slots 36 at the top and bottom to fit around hanging cable 26. This extension arm may be moved to any comfortable position along boards 14.

While certain particular arrangements, materials and dimensions have been detailed in the above description of preferred embodiments, these may be varied, where suitable, with similar results. Other variations, applications and ramifications of this invention will occur to those skilled in the art upon reading this disclosure. These are intended to be included within the scope of this invention, as defined by the appended claims.

I claim:

1. A hanging chair comprising:

a plurality of spaced parallel crosspieces;

a plurality of contour control boards arranged substantially perpendicular to said crosspieces, the first end of each of said contour boards filling the space between two adjacent crosspieces near each of the two ends of said crosspieces;

aligned holes through said contour board first ends and said crosspieces;

two body cables extending through said aligned holes at the crosspiece ends and fastened in a secure but flexible manner near the outermost crosspieces;

holes through said contour boards near the second ends thereof; and two hanging cables extending through the holes in said second ends and extending beyond said contour boards;

whereby said hanging cables may be attached to an overhead support to hang said chair in mid air.

2. The chair according to claim 1 further including backing boards behind and substantially coextensive with the endmost crosspieces, said contour control boards adjacent to said backing boards extending beyond said crosspieces and between said backing boards, the extended portion of said contour boards and adjacent backing boards having aligned holes therethrough and said body cable extending from said outermost crosspiece back through said backing boards.

3. The chair according to claim 2 further including a brace board engaging the uppermost contour control boards, said brace board having two holes near the ends lying perpendicular to the holes in said crosspieces, whereby said body cable extends from the aligned crosspiece and contour board holes, through said brace board holes and then through the aligned backing board and contour board holes.

4. The chair according to claim 1 wherein the last several contour control boards are progressively longer towards at least one of the upper and lowermost crosspieces.

5. The chair according to claim 1 wherein said holes have diameters from a diameter equal to that of the cable passing therethrough to a diameter about 1/16 inch greater, whereby said cables will jam in place if said cables are pulled at angles more than slightly off of the hole axis.

6. The chair according to claim 1 wherein a selected one of said contour control boards on each side of said chair has a substantially greater length than adjacent contour boards, whereby said longer board may serve as an armrest for a chair occupant.

7. The chair according to claim 1 further including a pair of contour control board extensions adapted to be placed over the ends of selected contour boards to serve as armrests for chair occupants, each of said extensions comprising a socket at one end adapted to tightly fit over the outer end of any of said contour boards, said socket having slots in the upper and lower sides to clear said hanging cable passing through the contour board ends, and an extended arm at the other end generally similar to said contour control boards.

8. The chair according to claim 1 wherein said crosspieces have their smallest dimension perpendicular to the contiguous contour control boards, whereby an occupant of the chair bears against a greater dimension of said crosspieces.

* * * * *